US009457399B2

(12) United States Patent
Prest et al.

(10) Patent No.: US 9,457,399 B2
(45) Date of Patent: Oct. 4, 2016

(54) INJECTION MOLDING AND CASTING OF MATERIALS USING A VERTICAL INJECTION MOLDING SYSTEM

(75) Inventors: Christopher D. Prest, San Francisco, CA (US); Dermot J. Stratton, San Francisco, CA (US); Joseph C. Poole, San Francisco, CA (US); Matthew S. Scott, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/394,350

(22) PCT Filed: Apr. 16, 2012

(86) PCT No.: PCT/US2012/033800
§ 371 (c)(1),
(2), (4) Date: Jun. 17, 2015

(87) PCT Pub. No.: WO2013/158069
PCT Pub. Date: Oct. 24, 2013

(65) Prior Publication Data
US 2015/0298206 A1 Oct. 22, 2015

(51) Int. Cl.

| | |
|---|---|
| ***B22D 17/20*** | (2006.01) |
| ***B22D 17/02*** | (2006.01) |
| ***B22D 17/12*** | (2006.01) |
| ***B22D 17/14*** | (2006.01) |
| ***B22D 17/28*** | (2006.01) |

(52) U.S. Cl.
CPC ..... *B22D 17/2038* (2013.01); *B22D 17/02* (2013.01); *B22D 17/12* (2013.01); *B22D 17/14* (2013.01); *B22D 17/203* (2013.01); *B22D 17/28* (2013.01)

(58) Field of Classification Search
CPC .... B22D 17/12; B22D 17/14; B22D 17/203; B22D 17/2038
USPC ..... 164/113, 303–318
See application file for complete search history.

(56) References Cited

U.S. PATENT DOCUMENTS

| | | | | |
|---|---|---|---|---|
| 2,195,360 | A | 3/1940 | Daesen | |
| 4,086,953 | A | 5/1978 | Kraklau | |
| 4,347,889 | A | 9/1982 | Komatsu et al. | |
| 4,899,804 | A * | 2/1990 | Hammerer | B22D 17/203 164/312 |
| 6,427,754 | B1 * | 8/2002 | Ozcan | B22D 19/08 164/113 |
| 6,502,624 | B1 | 1/2003 | Williams et al. | |

FOREIGN PATENT DOCUMENTS

| | | |
|---|---|---|
| EP | 0569511 | 11/1993 |
| EP | 0718059 | 6/1996 |
| EP | 0912277 | 5/1999 |
| JP | 01313175 A * | 12/1989 |

OTHER PUBLICATIONS

International Search Report and Written Opinion, mail date Dec. 18, 2012, PCT/ISA/210, PCT/ISA/220, PCT/ISA/237.

* cited by examiner

*Primary Examiner* — Kevin E Yoon
(74) *Attorney, Agent, or Firm* — Brownstein Hyatt Farber Schreck, LLP

(57) ABSTRACT

An injection molding system and methods for improving performance of the same. The system includes a plunger rod and a melt zone that are provided in-line and on a vertical axis. The plunger rod is moved in a vertical direction through the melt zone to move molten material into a mold. The injection molding system can perform the melting and molding processes under a vacuum. Skull formation in molten material is reduced by providing an RF transparent sleeve in the melt zone and/or a skull trapping portion adjacent an inlet of the mold. It can also be controlled based on the melting unit. Vacuum evacuation can be reduced during part ejection by using a plunger seal, so that evacuation time between cycles is reduced.

17 Claims, 7 Drawing Sheets

RELATIVE MOVEMENT OF SLEEVE AND MOLD WITH SKULL TRAP

VACUUM SEALING PLUNGER ROD

COLD SKULL INJECTION CASTING

FIG. 12 SOLIDIFIED SKULL FORMS ON WALLS, ACTS AS BARRIER AND IS IMMOBILIZED (NOT DRAWN IN TO PART AS WITH CONVENTIONAL DIE-CASTING MACHINES)

INJECTION MOLDING AND CASTING OF MATERIALS USING A VERTICAL INJECTION MOLDING SYSTEM

CROSS REFERENCE TO RELATED APPLICATION(S)

This application is the U.S. National Phase of PCT/US2012/033800, filed Apr. 16, 2012, the entire contents of which are hereby incorporated by reference in its entirety.

BACKGROUND

1. Field

The present disclosure is generally related to a system and method for melting and molding meltable materials.

2. Description of Related Art

Various methods have been used to mold molten metal materials. For example, die casting generally consists of injecting molten metal under high pressure into a mold. There are two methods typically used to inject molten metal into a mold: cold chamber and hot chamber. In hot chamber methods, low melting point alloys are used in a gooseneck feeding system, where the injection mechanism is immersed in the molten metal bath. On the other hand, in cold chamber methods, higher melting point alloys (e.g., aluminum alloy) can be used and melted in a crucible before pouring into a cold chamber. Some variations of a cold chamber include squeeze casting and semi-solid molding.

As molten material is moved along and/or into a mold to produce a part, the molten material can start to solidify, because it comes into contact with cooler walls/surfaces of the device being used for molding. Accordingly, there can form a solidified region of material within the melt, which, if molded into a part, can produce frozen and/or crystalline structures (also called skull material). The material can be unpredictable and thus a molded part can lack homogeneous properties. Molding with skull material can diminish the final quality of the part after it is formed and degrade its mechanical properties.

SUMMARY

One aspect of this disclosure provides an injection molding system having: a melt zone configured to melt meltable material received therein, the melt zone including an induction source positioned within the melt zone that is configured to heat the meltable material and a shot sleeve for moving the molten material therethrough, and a plunger rod configured to move molten material from the melt zone and into a mold, the plunger rod and melt zone being provided in-line and on a vertical axis, such that the plunger rod is moved in a vertical direction at least through the melt zone to move the molten material into the mold, wherein the shot sleeve is formed from an RF transparent material.

Another aspect of this disclosure provides an injection molding system having: a melt zone configured to melt meltable material received therein; a plunger configured to eject molten material from the melt zone and into a mold, the plunger and melt zone being provided in-line and on a vertical axis, such that the plunger is moved in a vertical direction at least through the melt zone to move the molten material into the mold, and the mold configured to receive molten amorphous alloy through an inlet and configured to mold material under vacuum, wherein the mold includes at least one skull catching portion within the inlet of the mold configured to trap skull material from the molten material therein before the plunger moves the molten material into the mold as it is moved in the vertical direction.

Another aspect of the disclosure provides an injection molding system having: a plunger configured to eject molten material from a melt zone and into a mold, the plunger and melt zone being provided in-line and on a vertical axis, such that the plunger is moved in a vertical direction at least through the melt zone to move the molten material into the mold; at least the mold configured for vacuum sealing by a vacuum, the mold comprising a first plate and a second plate configured to mold material therebetween so as to substantially eliminate exposure of the material therebetween to oxygen and nitrogen, and at least one of the first plate or second plate configured for relative movement with respect to the other plate; wherein the plunger comprises at least one seal adjacent an end of the plunger used to move molten material into the mold, such that upon movement of the plunger in a first vertical direction during ejection of the molten material the seal is configured to remain contactless with at least the mold and configured to move with the plunger, and upon movement of the plunger in a second vertical direction that is opposite the first vertical direction, the seal is configured to contact the mold and reduce loss of vacuum from the mold.

Yet another aspect of this disclosure provides an injection molding system having: a melt zone configured to melt meltable material received therein, the melt zone including an induction source positioned within the melt zone that is configured to melt the meltable material and a container for receiving and holding the meltable material, and a plunger configured to move molten material from the melt zone and into a mold, the plunger and melt zone being provided in-line and on a vertical axis, such that the plunger is moved in a vertical direction at least into the melt zone to move the molten material into the mold. The plunger is configured to move into the container holding molten material and move the molten material via pressure into the mold.

Another aspect of this disclosure provides a method including: providing an apparatus with a melt zone for receiving meltable material and a mold for molding the meltable material in a molten state; providing a plunger configured to eject molten material from the melt zone and into the mold, the plunger and melt zone being provided in-line and on a vertical axis, such that the plunger is moved in a vertical direction at least through the melt zone to move the molten material into the mold; providing a material to be melted within the melt zone, the melt zone including an induction source positioned therein and a sleeve for moving the molten material therethrough; applying a vacuum to the apparatus; melting the material under vacuum by applying power to the induction source; and using a plunger rod to move molten material from the melt zone, through the sleeve, and into the mold, wherein the sleeve is formed from an RF transparent material.

Yet another aspect of this disclosure provides a method including: providing an apparatus with a melt zone for receiving meltable material and a mold for molding the meltable material in a molten state, the mold configured to receive molten material through an inlet; providing a plunger configured to eject molten material from the melt zone and into the mold, the plunger and melt zone being provided in-line and on a vertical axis, such that the plunger is moved in a vertical direction at least through the melt zone to move the molten material into the mold; providing a material to be melted within the melt zone, the melt zone including an induction source positioned therein; applying a vacuum to the apparatus; melting the material under vacuum by applying power to the induction source; and using a plunger rod to move molten material from the melt zone and into the mold, wherein the system comprises at least one skull catching portion adjacent the inlet of the mold configured to trap skull material from the molten material therein before the plunger moves the molten material through the inlet of the mold as it is moved in the vertical direction.

Still another aspect of this disclosure provides a method including: providing an apparatus with a melt zone for receiving meltable material and a mold for molding the meltable material in a molten state, the melt zone having a container for receiving and holding the meltable material; providing a plunger configured to eject molten material from the melt zone and into the mold, the plunger and melt zone being provided in-line and on a vertical axis, such that the plunger is moved in a vertical direction at least through the melt zone to move the molten material into the mold; providing a material to be melted within the melt zone, the melt zone including an power source positioned therein; melting the material by applying power to the power source; and using the plunger rod to move molten material from the melt zone and into the mold, wherein the plunger is configured to move into the container holding molten material and move the molten material via pressure into the mold.

Other features and advantages of the present disclosure will become apparent from the following detailed description, the accompanying drawings, and the appended claims.

BRIEF DESCRIPTION OF THE DRAWINGS

FIG. 12 illustrates a detailed view of the walls of the plunger tip and container of FIG. 10.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
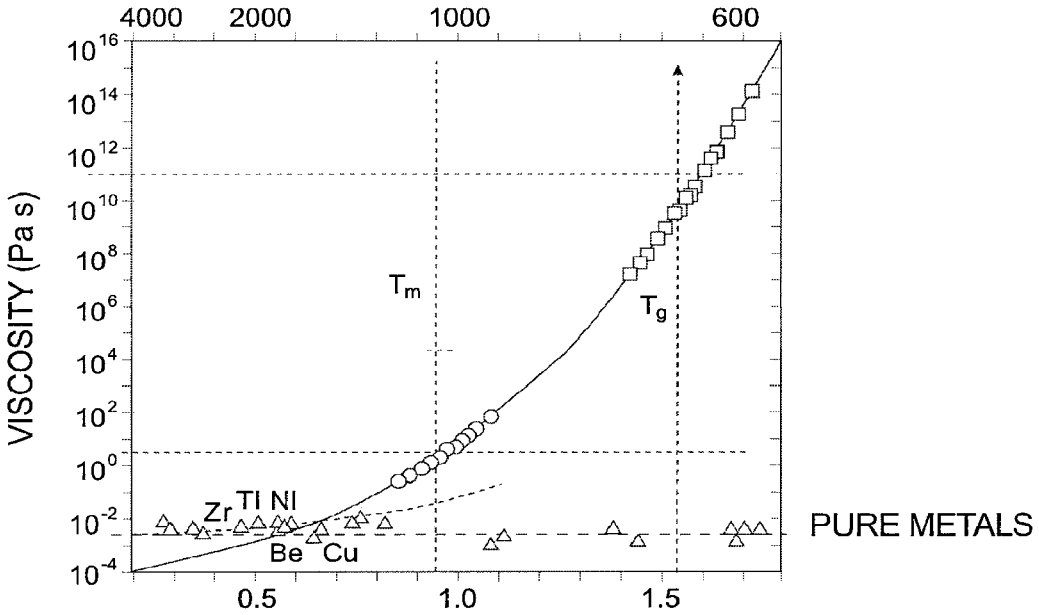
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
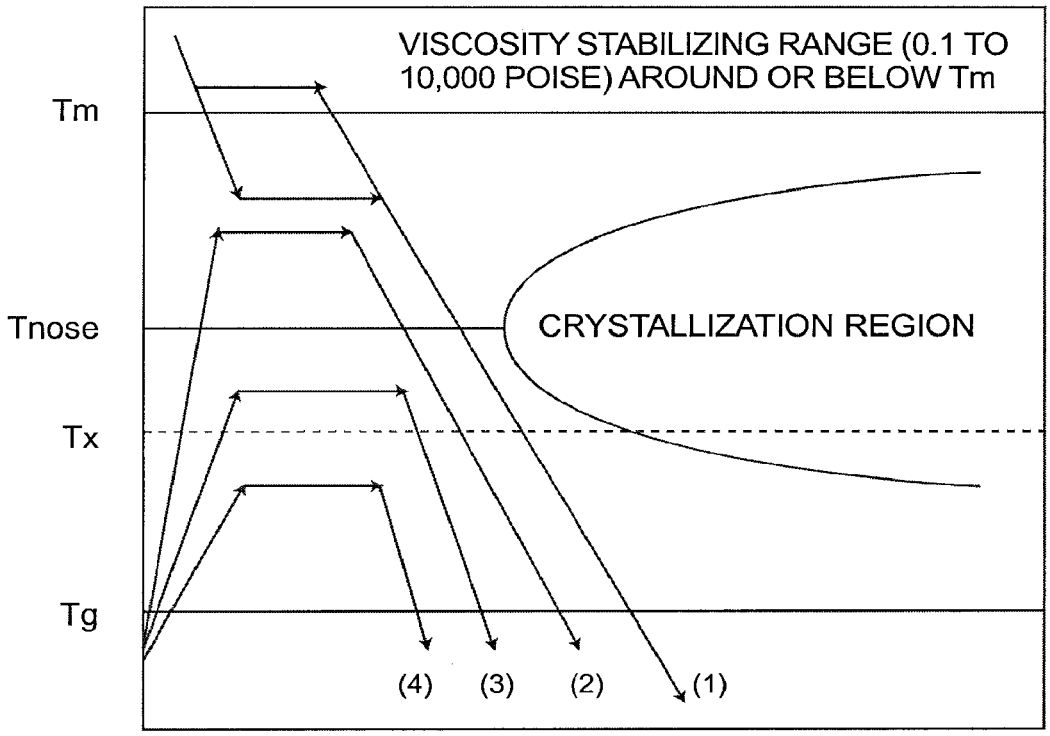
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys.

In this temperature region the bulk solidifying alloy can exist as a high viscous liquid. The viscosity of the bulk solidifying alloy in the supercooled liquid region can vary between 1012 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 1 (*b*), Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, has sium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™ such as Vitreloy-1 and Vitreloy-101, as fabricated by Liquidmetal Technologies, CA, USA. Some examples of amorphous alloys of the different systems are provided in Table 1 and Table 2.

TABLE 1

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |

TABLE 1-continued

| Additional Exemplary amorphous alloy compositions (atomic %) | | | | | | |
|---|---|---|---|---|---|---|
| Alloy | Atm % | Atm % | Atm % | Atm % | Atm % | Atm % |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

TABLE 2

| Exemplary amorphous alloy compositions | | | | | | | | |
|---|---|---|---|---|---|---|---|---|
| Alloy | Atm % | Atm % | Atm % | Atm % | Atm % | Atm % | Atm % | Atm % |
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo-Ln-C—B, Fe—Mn—Cr—Mo—(Y,Ln)—C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72Al7Zr10Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Co4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods, techniques, and devices illustrated herein are not intended to be limited to the illustrated embodiments.

As disclosed herein, an apparatus or a system (or a device or a machine) is configured to perform melting of and injection molding of material(s) (such as amorphous alloys). The apparatus is configured to process such materials or alloys by melting at high melting temperatures before injecting the molten material into a mold for molding. As further described below, parts of the apparatus are positioned in-line with each other. In accordance with some embodiments, parts of the apparatus (or access thereto) are aligned on a vertical axis.

The following embodiments are for illustrative purposes only and are not meant to be limiting. Also, it should be understood that each of the views in FIGS. 3-11 are cross sectional views of parts of an injection molding system (e.g., taken vertically through a center of the machine).

Figure 3:
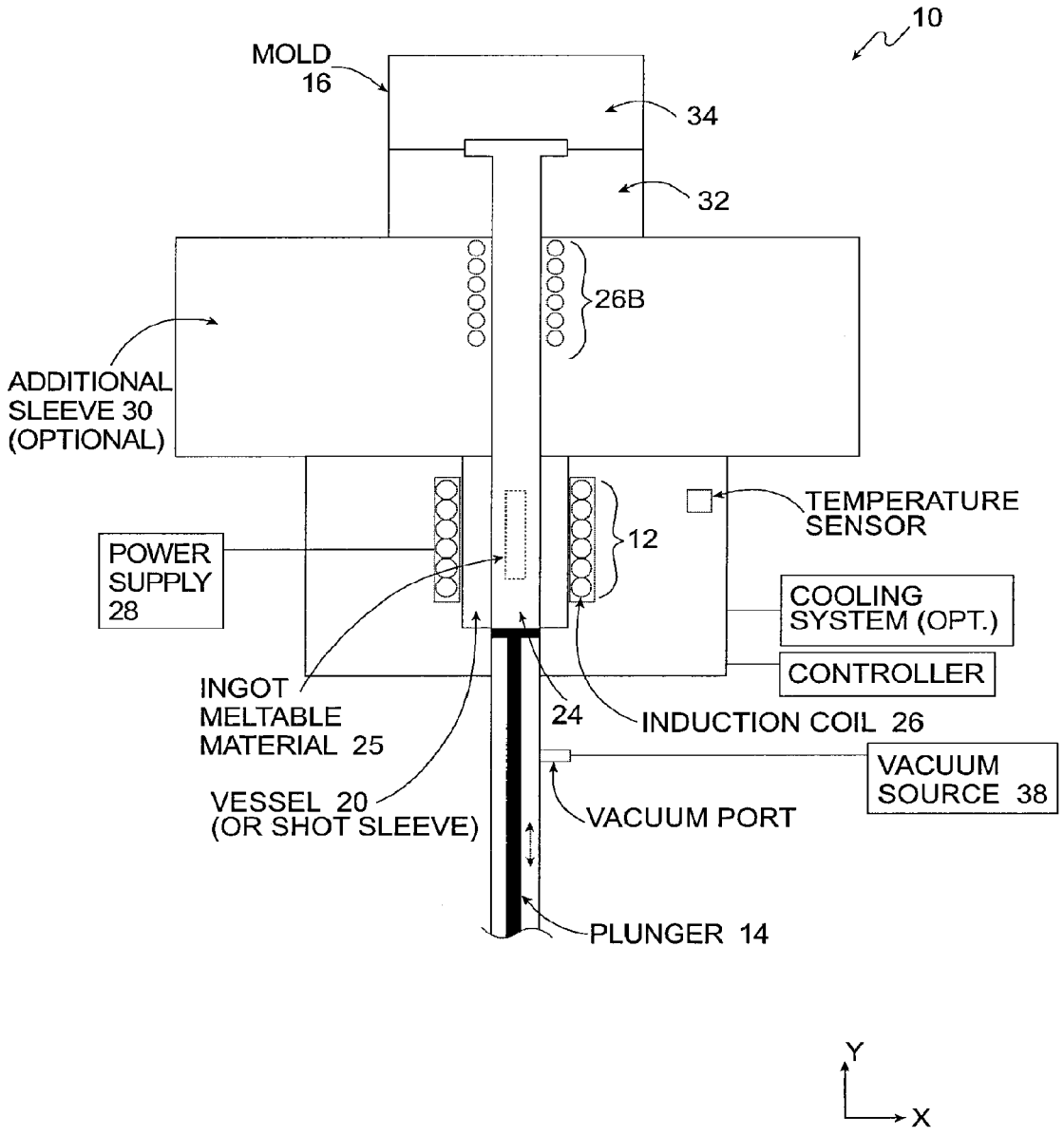
FIG. 3 illustrates a schematic diagram of an exemplary vertical injection molding system in accordance with an embodiment.

FIG. 3 illustrates a schematic diagram of an exemplary injection molding apparatus or system 10 used to melt and mold material. In accordance with an embodiment, injection molding system 10 has a melt zone 12 configured to melt meltable material received therein, and at least one plunger rod 14 configured to eject molten material from melt zone 12 and into a mold 16. In an embodiment, at least plunger rod 14 and melt zone 12 are provided in-line and on a vertical axis (e.g., Y axis), such that plunger rod 14 is moved in a vertical direction (e.g., along the Y-axis) substantially through melt zone 12 to move the molten material into mold 16. The mold can be positioned adjacent to the melt zone.

The plunger 14 is configured to move in a first vertical direction towards the mold to move molten material from melt zone 12 and into mold 16, as well as in a second vertical direction that is opposite to the first vertical direction, e.g., when starting the injection molding process and/or to position material in the melt zone 12. In an embodiment, the plunger rod 14 is a temperature regulated rod that includes one or more temperature regulating lines configured to flow a liquid (e.g., water, or other fluid) therein for regulating a temperature of at least a tip of the plunger near an end of the plunger that contacts and moves molten material from melt zone 12 and into mold 16 (and can be used during molding). The cooling line(s) can assist in preventing excessive heating and melting of the tip and/or body of the plunger rod itself. Cooling line(s) may be connected to a cooling system configured to induce flow of a liquid in the vessel. The cooling line(s) may include one or more inlets and outlets for the liquid or fluid to flow therethrough. The inlets and outlets of the cooling lines may be configured in any number of ways and are not meant to be limited.

The material to be melted, or "meltable material", can be received in the melt zone in any number of forms. For example, the meltable material may be provided into melt zone 12 in the form of an ingot (solid state), a semi-solid state, a slurry that is preheated, powder, pellets, etc. For explanatory purposes only, throughout this disclosure meltable material is described and illustrated as being in the form of an ingot 25 that is in the form of a solid state feedstock; however, it should be noted that the material to be melted may be received in the injection molding system or apparatus 10 in a solid state, a semi-solid state, a slurry that is preheated, powder, pellets, etc., and that the form of the material is not limiting. In some embodiments, a loading port may be provided as part of injection molding system 10. The loading port can be a separate opening or area that is provided within the machine at any number of places. In an embodiment, the loading port may be a pathway through one or more parts of the machine. For example, the material (e.g., ingot) may be inserted in a vertical direction into melt zone 12 by plunger 14, or may be inserted in a vertical direction from the mold side of the injection system 10 (e.g., through mold 16 and/or through a sleeve 30). In other embodiments, the meltable material can be provided into melt zone 12 in other manners and/or using other devices (e.g., through an opposite end of the injection system).

Melt zone 12 includes a melting mechanism configured to receive meltable material and to heat the material to a molten state. The melting mechanism may be in the form of a vessel or sleeve 20, for example, that has a body for receiving meltable material and configured to melt the material therein. A vessel as used throughout this disclosure is a container made of a material employed for heating substances to high temperatures. For example, in an embodiment, the vessel may be a crucible. In an embodiment, vessel 20 is a cold hearth melting device that is configured to be utilized for meltable material(s) while under a vacuum (e.g., applied by a vacuum device 38 or pump). In some embodiments, the vessel is a temperature regulated vessel. Vessel 20 can comprise any number of shapes or configurations. The body of the vessel has a length and can extend in a longitudinal and vertical direction, such that molten material is ejected vertically therefrom using plunger 14.

In embodiments, the vessel 20 or sleeve may be configured to receive the plunger rod therethrough in a vertical direction (e.g., first vertical direction) to move the molten material into the mold 16. That is, in an embodiment, the melting mechanism is on the same axis as the plunger rod, and the vessel can be configured and/or sized to receive at least part of the plunger rod therethrough. Thus, plunger rod 14 can be configured to move molten material (after heating/melting) from the vessel by moving substantially through vessel 20, and into mold 16. Referencing the illustrated embodiment of system 10 in FIG. 3, for example, plunger rod 14 would move in a first vertical direction from the bottom towards the top (upwardly), through vessel 20, moving and pushing the molten material towards and into mold 16. Further description regarding such embodiments (e.g., FIGS. 4-7) is provided further below.

In another embodiment, the vessel 20 is provided in the form of a crucible or container, such that material is held within the crucible until it is melted (e.g., see FIGS. 8-11). The plunger rod 14 can be used to move molten material (after heating/melting) from the vessel by moving into the vessel 10 and providing pressure such that the molten material is moved into mold 16. Further description regarding such an embodiment is provided further below.

To heat melt zone 12 and melt the meltable material received in vessel 20, injection system 10 also includes a heat source that is used to heat and melt the meltable material. At least the vessel, if not the path for movement itself, is configured to be heated such that the material received therein is melted. Heating is accomplished using, for example, an induction source 26 positioned within melt zone 12 that is configured to melt the meltable material. In an embodiment, induction source 26 is positioned adjacent vessel 20. For example, induction source 26 may be in the form of a coil positioned in a helical pattern substantially around a length of the vessel body or sleeve (see also FIGS. 4, 5, and 8-11). Accordingly, vessel 20 may be configured to inductively melt a meltable material (e.g., an inserted ingot) within melt zone by supplying power to induction source/coil 26, using a power supply or source 28. Thus, the melt zone 12 can include an induction zone. Induction coil 26 is configured to heat up and melt any material that is contained in melt zone 12 without melting and wetting vessel 20. Induction coil 26 emits radiofrequency (RF) waves towards melt zone 12 (and towards vessel 20). The body of vessel 20 and coil 26 may be configured to be positioned longitudinally in a vertical direction along a vertical axis (e.g., Y axis).

After the material is melted in the melt zone 12, plunger 14 may be used to force the molten material from the melt zone 12 and into a mold 16 for molding into an object, a part or a piece. In instances wherein the meltable material is an alloy, such as an amorphous alloy, the mold 16 is configured to form a molded bulk amorphous alloy object, part, or piece. Mold 16 has an inlet for receiving molten material therethrough. An output of the vessel 20 and an inlet of the mold 16 can be provided in-line and on a vertical axis such that plunger rod 14 is moved in a first vertical direction through body of the vessel to eject molten material and into the mold 16 via its inlet.

As previously noted, systems such as injection molding system 10 that are used to mold materials such as metals or alloys may implement a vacuum when forcing molten material into a mold or die cavity. Injection molding system 10 can further includes at least one vacuum source 38 or pump that is configured to apply vacuum pressure to at least melt zone 12 and mold 16. The vacuum pressure may be applied to at least the parts of the injection molding system 10 used to melt, move or transfer, and mold the material therein. For example, the vessel 20, optional sleeve 30 (described below), and plunger rod 14 may all be under vacuum pressure and/or enclosed in a vacuum chamber.

In an embodiment, mold 16 is a vacuum mold that is an enclosed structure configured to regulate vacuum pressure therein when molding materials. For example, in an embodiment, vacuum mold 16 comprises a first plate 32 (also referred to as an "A" mold or "A" plate) and a second plate 34 (also referred to as a "B" mold or "B" plate) positioned adjacently (respectively) with respect to each other. The first plate 32 and second plate 34 generally each have a mold cavity associated therewith for molding melted material therebetween. The cavities are configured to mold molten material received therebetween via plunger 14 (pushing from melt zone 12, sometimes via injection sleeve or optional transfer sleeve 30). The mold cavities may include a part cavity for forming and molding a part therein. The plates 32 and 34 of the mold are configured for vacuum sealing by a vacuum. When vacuum sealed, exposure of the material being molded between the plates to oxygen and nitrogen is substantially eliminated. Also, at least one of the first plate 32 or second plate 34 are configured for relative movement with respect to the other plate. For example, to eject a molded part, second plate 34 is moved relative to and away from first plate 32. To mold a part, second plate 34 is moved relative and towards first plate 32.

Generally, in an embodiment, the first plate 32 may be connected to an optional additional sleeve 30 (also referred to as a transfer sleeve). In accordance with an embodiment, plunger rod 14 is configured to move molten material from vessel 20, through sleeve 30, and into mold 16. Sleeve 30 (sometimes referred to as an injection sleeve in the art and herein) may be provided between melt zone 12 and mold 16. Sleeve 30 has an opening that is configured to receive and allow transfer of the molten material therethrough and into mold 16 (using plunger 14). Its opening may be provided in a vertical direction along the vertical axis (e.g., Y axis). The transfer sleeve need not be a cold chamber. For example, in an embodiment, a heat source that is used to heat and melt the meltable material as it is moved towards the mold 16 may be provided within sleeve 30. Heating is accomplished using, for example, a secondary induction source 26B positioned in or adjacent sleeve 30 that is configured to maintain the material in a molten state, for example. In an embodiment, secondary induction source 26B is positioned adjacent an inlet of mold 16. Induction source 26B may be in the form of a coil positioned in a helical pattern substantially around at least a portion of the length of the vessel body or sleeve (see also FIGS. 4, 5, and 8-11), e.g., in a vertical direction along a vertical axis. Accordingly, secondary induction coil 26B may be configured to continue to inductively melt and/or maintain the meltable material in its molten state by supplying power to secondary induction coil 26B, using a power supply or source 28. Thus, the sleeve 30 or transfer area before the mold can include an induction zone. Secondary induction coil 26B can emit radiofrequency (RF) waves towards sleeve 30.

In an embodiment, at least plunger rod 14, melt zone 12/vessel 20, and opening of the sleeve 30 (if present) are provided in-line and on a vertical axis, such that plunger rod 14 can be moved in a vertical direction through vessel 20 in order to move the molten material into (and subsequently through) the opening of sleeve 30, and into mold (via its inlet). Molten material is pushed in a vertical direction through sleeve 30 and into the mold cavity(ies) via the inlet (e.g., in a first plate) and between the first and second plates. During at least molding of the material, the at least first and second plates 32 and 34 are configured to substantially eliminate exposure of the material (e.g., amorphous alloy) therebetween to at least oxygen and nitrogen. Specifically, a vacuum is applied such that atmospheric air is substantially eliminated from within the plates and their cavities. A vacuum pressure is applied to an inside of vacuum mold 16 using at least one vacuum source 38 that is connected via vacuum lines. An ejector mechanism (not shown) is configured to eject molded (amorphous alloy) material (or the molded part) from the mold cavity between the first and second plates of mold 16, when the mold is opened. The ejection mechanism is associated with or connected to an actuation mechanism (not shown) that is configured to be actuated in order to eject the molded material or part (e.g., after first and second parts and are moved vertically and relatively away from each other).

Any number or types of molds may be employed in the apparatus 10. For example, any number of plates may be provided between and/or adjacent the first and second plates to form the mold. Molds known as "A" series, "B" series, and/or "X" series molds, for example, may be implemented in injection molding system/apparatus 10.

Generally, the injection molding system 10 may be operated in the following manner: The vacuum is applied to the injection molding system 10. Meltable material (e.g., amorphous alloy or BMG) is loaded into a feed mechanism while held under vacuum, and a single ingot (feedstock) is loaded, inserted and received into the melt zone 12 (surrounded by the induction coil 26). The material is heated through the induction process (electrical RF waves). Once a desired temperature of the material is achieved and maintained to melt the meltable material, the machine will then begin the injection of the molten material from melt zone 12, through sleeve 30 (if provided), and into vacuum mold 16 by moving in a vertical direction (from bottom to top) along the vertical axis. This may be controlled using plunger 14, which can be activated using a servo-driven drive or a hydraulic drive. The mold 16 is configured to receive molten material through an inlet and configured to mold the molten material under vacuum. That is, the molten material is injected into a cavity between the at least first and second plates to mold the part in the mold 16. Once the mold cavity has begun to fill, vacuum pressure (via the vacuum lines and vacuum source 38) can be held at a given pressure to "pack" the molten material into the remaining void regions within the mold cavity and mold the material. The plunger 14 remain in place (e.g., adjacent or within the inlet of the mold 16) as the material is solidified. After the molding process (e.g., approximately 10 to 15 seconds), the vacuum pressure applied to the mold 16 may be released. For example, the pressure can be released using a valve and/or a vacuum port. Mold 16 is then opened to relieve pressure (but not necessarily all) and to expose the part for ejection. Once ejected, the process can begin again. Mold 16 can then be closed by moving at least the at least first and second plates relative to and towards each other such that the first and second plates are adjacent each other. The melt zone 12 and mold 16 is evacuated via the vacuum source 38, and the plunger 14 can be moved back into a load position, in order to insert and melt more material and mold another part, thereby beginning the cycle again.

Figure 4:
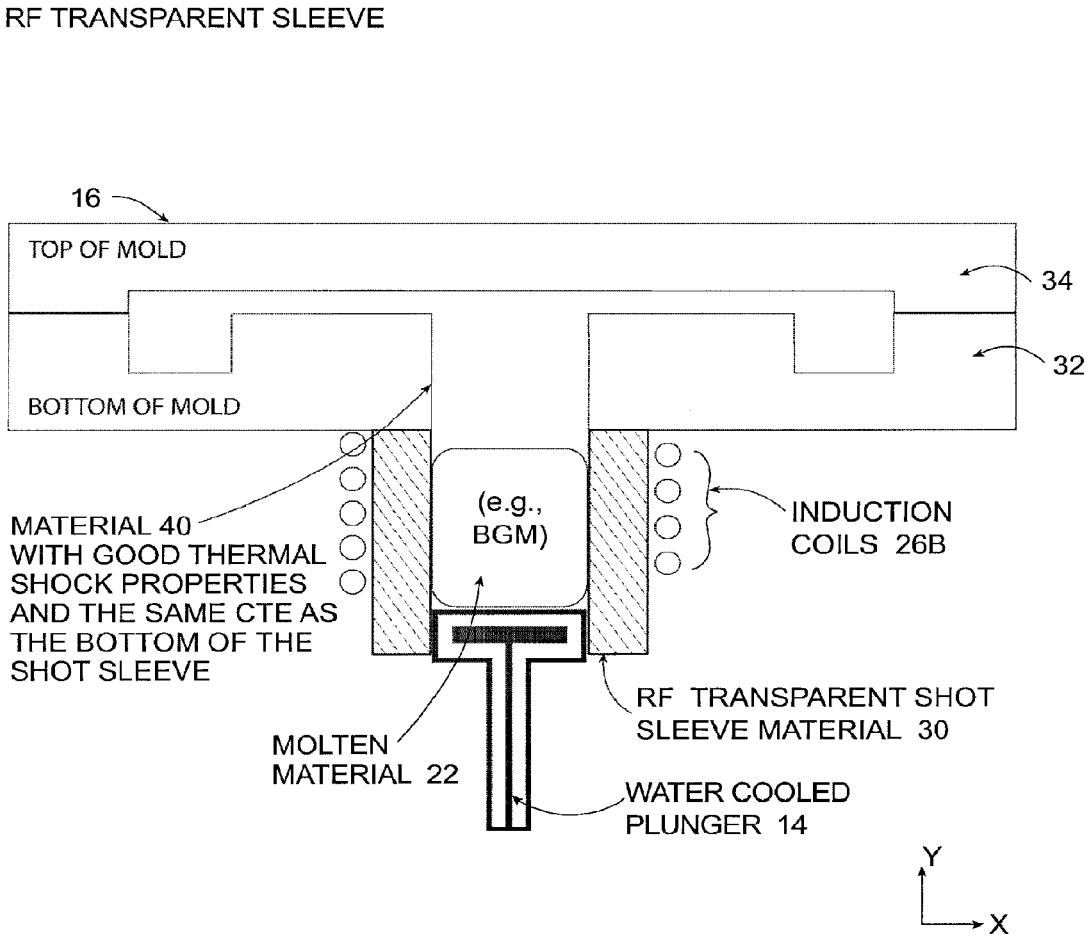
FIG. 4 illustrates an RF transparent composite sleeve that can be implemented within a system such as the vertical system of FIG. 3, in accordance with an embodiment.

As previously noted, as molten material is processed (e.g., moved into the mold), skull material may be formed therein, either due to cooling or crystallizing, which is undesirable. Improvements can be made to the machine in order to prevent skull material and/or degradation in quality of parts (e.g., through exposure to the atmosphere). In order to further improve casting or molding of meltable materials (such as amorphous alloys) using a vertical system such as system 10 in FIG. 3, and to prevent formation of such skull material, one or more additional features may be implemented in system 10. For example, the size or length of optional sleeve 30 (shown in FIG. 3) can be reduced, as shown in FIG. 4, and/or not provided within system 10. That is, the vessel or shot sleeve 20 is provided closer to the mold 16. Optionally, in another embodiment, sleeve 30 and its heat source (coil 26B) alone may be provided in the melt zone 12 (e.g., see FIGS. 4-5) (i.e., vessel 20 not being provided). In either manner, a traveling distance for molten material 22 from melt zone 12 to mold 16 is minimized, thereby reducing temperature loss from molten material 22 and the likelihood of forming skull material. In an embodiment where both vessel 20 and sleeve 30 are provided in system 10, a secondary induction coil 26B can be positioned around or adjacent sleeve 30, for example, to provide additional heat to the molten material 22 (e.g., molten BMG) as it is moved via plunger 14 towards mold 16.

In the illustrated embodiment of FIG. 4, the melt zone 12 includes sleeve 30B and coil 26B. In an embodiment, sleeve 30 is formed from an RF transparent material. For example, the sleeve 30 may be formed from a ceramic or quartz material. This allows for induction melting to occur in situ (via RF waves from secondary induction source 26B), and maintain or heat molten material 22 as is moved through sleeve 30 and into mold 16. This induction heating close to the mold inlet can assist in maintaining material in its molten state and reduce and/or prevent heat loss and the formation of skull material therein as well before injection into mold 16.

In an embodiment, the mold inlet includes at least a layer of material 40 with good thermal shock properties for contact with molten material. In another embodiment, the material 40 that is used and in contact with molten material has as similar Coefficient of Thermal Expansion (CTE) as the sleeve, so that most of and/or all sections of the shot sleeve expand equally when heated by the molten alloy. This reduces chances of a stepped surface for the plunger to run over/contact, wear issues, and injection parameter inconsistencies.

In some cases, the inlet may include a removable section of material.

In some cases, prematurely formed skull material can remain adjacent or in contact with a tip or end of plunger 14 (e.g., such as if it is cooled) that is ejecting the molten material from melt zone 12 and moving into cavities of mold 16. However, due to induction heating close to the mold 16, such skull material may be melted therein.

Accordingly, the distance between the melt zone 12 and mold 16 are decreased in that additional heating occurs before injection into the mold.

Figure 5:
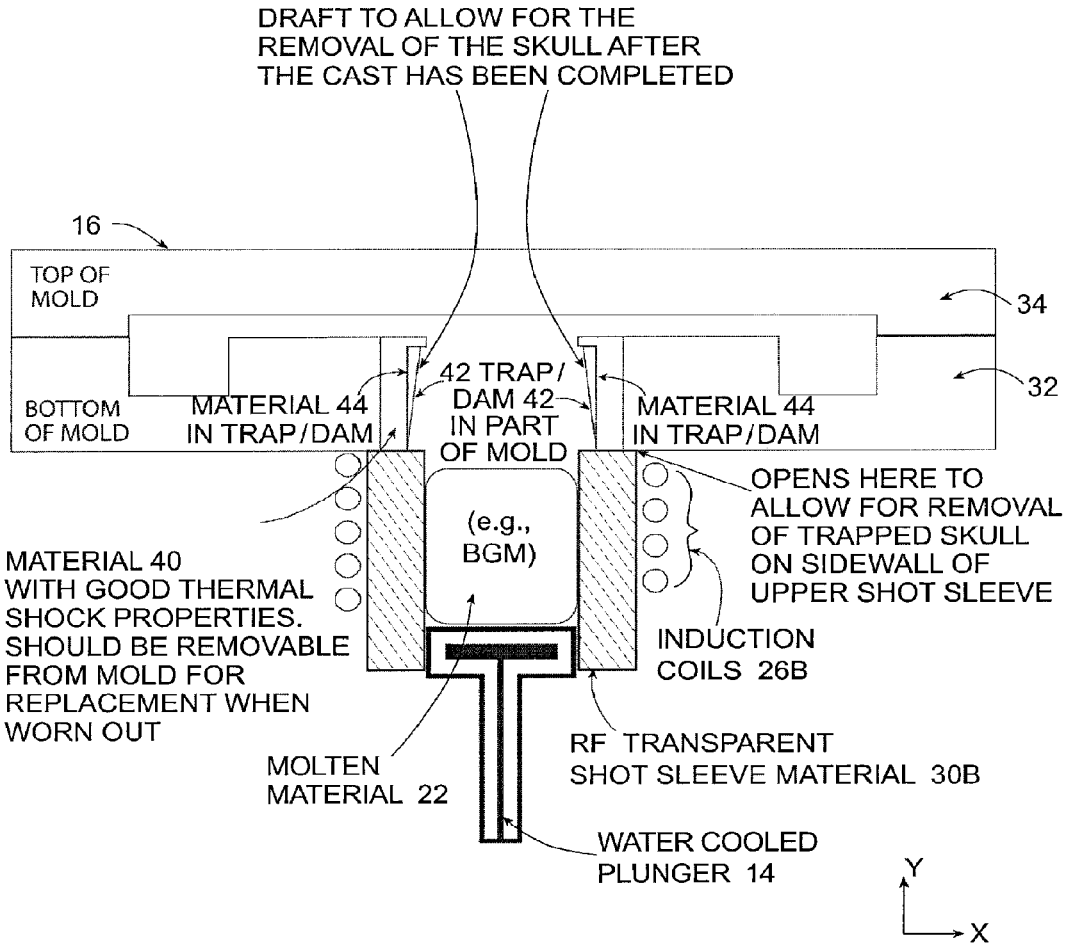
FIG. 5 illustrates a sleeve and a skull catching portion in a mold inlet configured to trap skull material in molten material, that can be implemented within a system such as the vertical system of FIG. 3, in accordance with an embodiment.

FIG. 5 illustrates another embodiment for minimizing skull material in molded parts by employing a trap adjacent the inlet of mold 16. Specifically, the mold has at least one skull catching portion 42 adjacent the inlet of mold 16 configured to trap skull material and to separate/remove it from molten material 22 before the plunger 14 moves molten material 22 into mold 16, as it is moved in the first, vertical direction (e.g., upwardly) (such as in vertical injection molding system 10 in FIG. 3). For example, as shown, the skull catching portion 42 may be provided within a first plate 32 of the mold 16. The skull catching portion 42 is a means of collecting skull material that has contacted any cold walls within the machine and has crystallized and/or solidified in the melt. Skull catching portion 42 reduces any skull material that may enter the mold cavities by capturing material and it is pushed or moved through (rather that being able to slip through the inlet). Specifically, the skull is mechanically separated from the molten material (alloy) as the molten material 22 is pushed through sleeve 30 and into mold 16 using tip of plunger rod 14.

In an embodiment, the at least one skull catching portion 42 includes a cavity. The cavity can extend around a perimeter or circumference of the inlet of mold 16. In an embodiment, the mold 16 includes two or more skull catching portions within its inlet. Each skull catching portion can include a cavity for trapping skull material from the molten material as it is injected into mold 16.

In an embodiment, the mold inlet includes at least a layer of material 40 with good thermal shock properties for contact with molten material. In an embodiment, layer of material 40 is provided within each skull catching portion 42. In some cases, the layer of material 40 may be removable such that it can be replaced (with similar material) due to, for example, wear.

Despite its configuration, as shown in FIG. 5, for example, material 44 may be trapped and hardened within the at least one skull catching portion 42 (shown both sides of the inlet). The dimensions of the at least one skull catching portion 42 may be formed such that hardened or solidified skull material within the portion 42 can be removed after casting or molding is complete. For example, in an embodiment wherein the cavity of skull catching portion 42 extends around an inside perimeter of an oval or circular inlet, a hardened loop of material 44 may be formed therein.

In the illustrated embodiment of FIG. 5, a sleeve 30B and coil 26B are provided in the melt zone, adjacent to mold 16. Sleeve 30B may be similar to sleeve 30, as previously described. In an embodiment, the sleeve 30B may be formed from an RF transparent material. In another embodiment, sleeve 30 is not RF transparent. However, in this embodiment, to remove any trapped skull material 44 from the portion 42 in the mold inlet, these adjacent parts are configured to move relative to each other. In an embodiment, either or both mold 16 and/or sleeve 30B may move relative to the other (e.g., in a opposite direction vertically away from each other). In another embodiment, the sleeve 30B is configured to move relative to the mold 16 in a vertical direction (e.g., downward or away from mold 16) so as to provide access to the at least one skull catching portion 42 in the mold inlet. In yet another embodiment, the mold 16 may move relative to the sleeve 30B (e.g., vertically upward). Accordingly, once the mold 16 and sleeve 30B are separate, and the skull catching portion 42 is accessible, the hardened material 44 may be removed from the skull catching portion 42.

Accordingly, the embodiment shown in FIG. 5 is an example of intentionally creating a solidified portion or layer of the meltable (casting) material in order to capture skull material from molten material for molding. In addition, once trapped, the hardened material can act as a barrier (thermally and chemically) for the remaining molten material as it is moved into the mold cavities.

Although FIG. 5 shows at least one skull catching portion 42 adjacent an inlet of the mold being within a first plate 32, it should be noted that skull catching portion(s) can also or alternatively be provided in sleeve 30B.

Figure 6:
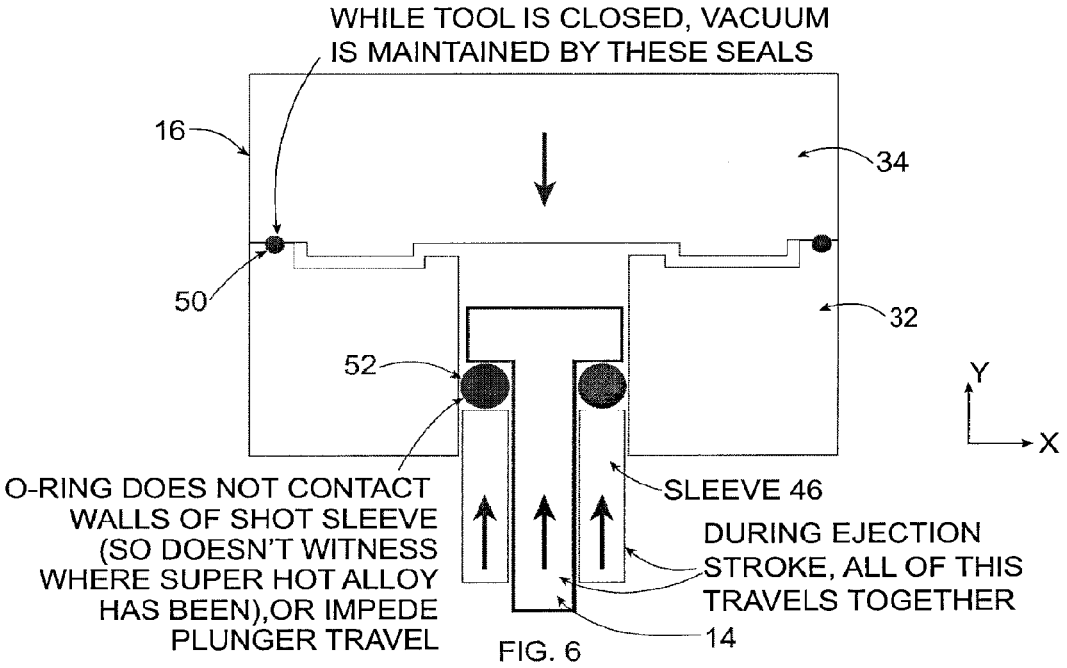
FIGS. 6-7 illustrate a vacuum sealed plunger rod that can be implemented within a system such as the vertical system of FIG. 3, in accordance with an embodiment.
Figure 7:
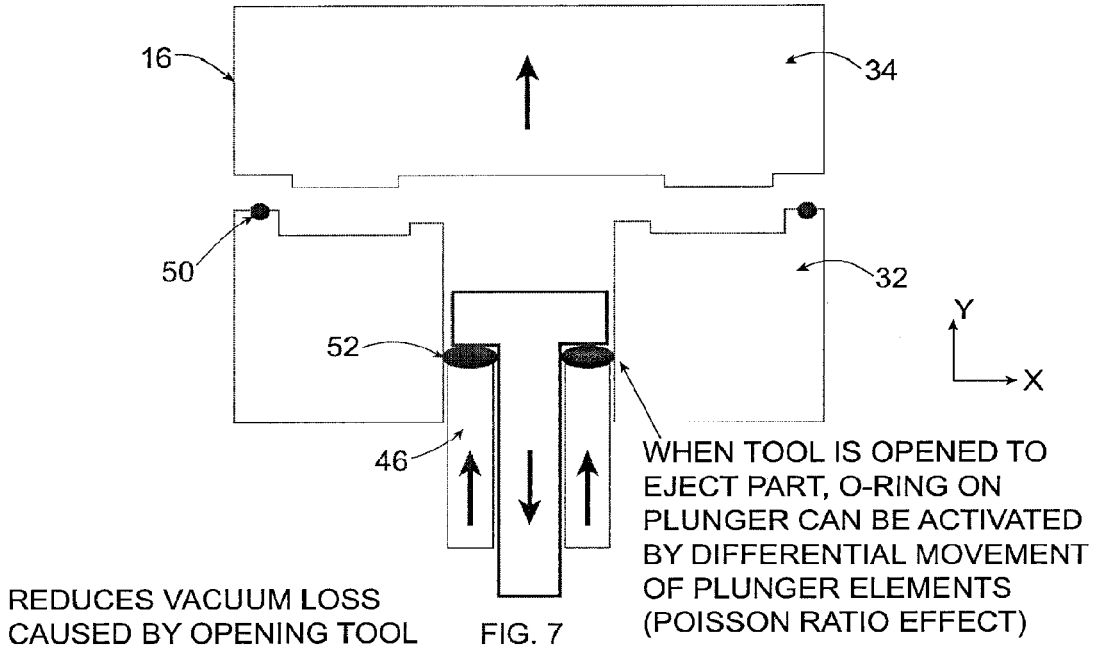

As was described generally above, each injection molding cycle implemented in a system 10 includes closing a mold 16 by moving at least the at least first and second plates relative to and towards each other and evacuating at least the melt zone and mold 16 via the vacuum source. FIGS. 6-7 illustrate a vacuum sealed plunger rod that can be implemented within a system such as the vertical injection molding system 10 of FIG. 3, in accordance with another embodiment, in order to improve at least a cycle time for melting and molding. This embodiment provides a configuration and method of maintaining at least some vacuum pressure at the mold of the machine so that a molded part can be ejected without breaking vacuum for the whole system. This aids in reducing vacuum pump down time, reducing overall machine cycle time, and in reducing atmospheric exposure.

FIG. 6 shows the mold 16 that is configured for vacuum sealing by a vacuum so as to substantially eliminate exposure of the material being molded therebetween (i.e., between first plate 32 and second plate 34) to oxygen and nitrogen. At least one of the first plate 32 or second plate 34 are configured for relative movement with respect to the other plate. At least one mold seal 50 (e.g., O-ring) is provided between adjacent interfaces of the first and second plates 32 and 34. FIG. 6 also shows that the plunger includes at least one seal 52 (e.g., O-ring) adjacent the plunger end that is used to move molten material into the mold 16, as well as an adjacent sleeve 46. Adjacent sleeve 46 is configured to move in the first vertical direction and towards mold 16 as well as to allow relative movement of the body of the plunger 14 therethrough during ejection of molten material in the first vertical direction. Adjacent sleeve 46 can move independently of plunger 14. Upon movement of the plunger 14 in a first vertical direction (i.e., upwardly) during ejection of the molten material into mold 16, the seal 52 is configured to remain contactless with at least walls of the sleeve and/or the mold and configured to move with the plunger 14. In some cases, as shown here, adjacent sleeve 46 moves with the plunger during ejection (in the first vertical direction).

However, adjacent sleeve 46 is not configured for movement with plunger 14 in a second vertical direction. Also, tip or end of plunger 14 and seal 52 are not configured for movement (downwardly) entirely through adjacent sleeve 46. Rather, adjacent sleeve 46 stops their complete movement therethrough. After the molding process, the molded part is ejected from mold 16 (e.g., via movement of second plate 34 relative to first plate 32). When mold 16 is opened to eject the part, the plunger 14 is configured for movement in an opposite, second vertical direction (i.e., opposite to the first, upward direction, or downwardly). In an embodiment, the movement of the plunger 14 and its seal 52 in the opposite, second direction is activated (i.e., compressed for contact with adjacent parts) upon relative movement of the at least one of the first plate 32 or second plate 34 with respect to the other plate such that a molded part is ejected from therebetween. As the plunger 14 moves in the second vertical direction, the adjacent sleeve 46 is configured to remain stationary relative to the mold 16 (as shown in FIG. 7). The seal 52 is configured to contact the at least the walls of the mold and an end of the adjacent sleeve 46. That is, adjacent sleeve 46 activates use of the seal 52 by differential movement of the plunger elements (Poisson ratio effect). Differential movement of the concentric plunger rod components (14 and 46), compresses seal 52 and causes it to expand radially. This provides sealing in the shot sleeve, allowing for only part of the system to require returning to atmospheric pressure during part ejection and cooling.

In alternate system designs, the tool side of the casting equipment is housed in a larger vacuum chamber, and the parts pass through this chamber, before exiting via an tertiary "air-lock" chamber. In this embodiment, the parts are able to be exposed to atmospheric pressure as soon as the tools open, allowing for more rapid cooling (via enhanced conduction and convection to the cover gas).

A benefit of sealing the system in this manner is two fold. Firstly, it reduces the chamber volume needed to pump down to low vacuum to allow for casting (e.g., reactive materials, oxygen sensitive, etc.), and so will allow for reduced cycle times. Secondly, it allows a portion of the system which may house hot and reactive components (e.g., when using crucibles or vessels which easily oxidize and degrade, such those made of as graphite) to stay at low pressure, and thus avoid increased oxidation rate.

This is turn reduces loss of vacuum from the mold 16 and the system as a whole, as the seal associated plunger assists in reducing exposure to the atmosphere.

Accordingly, the seal 52 and adjacent sleeve 46 that are associated with plunger 14 provide a means of sealing off the cavity for the mold 16 when removing a vacuum hold on the system (e.g., such as when ejecting the molded part). It reduces the amount of air that enters the system during part ejection, and thus, less time is needed to evacuate the atmospheric air (e.g., using a pump) from the system and to apply vacuum pressure to the mold and melt zone when the next cycle begins.

Although not explicitly described, it should be understood that each of the embodiments described above with reference to FIGS. 4-7 may be employed in an injection system such as vertical injection molding system 10, and that the molds (and their plates), plungers, and/or sleeves are associated with a melt zone (with or without an extra optional sleeve), and that the plungers are configured for vertical movement, as described previously and here throughout, for example.

FIGS. 8-11 illustrate steps in a method of cold skull injection casting that can be implemented within a vertical system in accordance with an embodiment. Rather than a vessel 20 or sleeve 30 for allowing plunger 14 to extend therethrough, the system or machine in FIGS. 8-11 includes a container 60 or skull melt unit configured to receive and hold the meltable material 22A therein (e.g., in the form of an ingot) within its melt zone 62. The container 60 may be a cold container in the form of a crucible, for example. However, parts with similar reference numbers may have similar features such as those provided above (e.g., mold 16B can have similar features as mold 16 of FIG. 3). Also included within the melt zone 62 is an induction source 66, which may be similar to induction source 26 (e.g., a coil), that is configured to melt the meltable material within container 60 or unit. Such description of the induction source is not repeated here. Accordingly, the melt zone 62 is configured to melt meltable material received therein.

Also provided is a plunger 14B configured to move molten material from the melt zone 62 and into a mold 16B. The plunger 14B and melt zone 62 are provided in-line and on a vertical axis, such that the plunger is moved in a vertical direction at least into the melt zone to move the molten material into the mold. In this embodiment, the plunger 14B is configured to move in a downward direction and into container 60 holding molten material. Additionally, the plunger 14 is configured to move in a first vertical direction away from the mold to move molten material from melt zone 62 and into mold 16B, as well as in a second vertical direction that is opposite to the first vertical direction. In an embodiment, the plunger rod 14B is a temperature regulated rod that includes one or more temperature regulating lines configured to flow a liquid (e.g., water, or other fluid) therein for regulating a temperature of at least a tip of the plunger near an end of the plunger that contacts and moves molten material from melt zone 62 and into mold 16B. The cooling line(s) can assist in preventing excessive heating and melting of the tip and/or body of the plunger rod itself, such as when it is provided within container 60 and in contact with molten material for ejecting it into mold 16B. Cooling line(s) can also be used to cool container 60. Wetting/soldering of material can be reduced by actively cooling the plunger and container 60. Cooling line(s) may be connected to a cooling system configured to induce flow of a liquid in the vessel. The cooling line(s) may include one or more inlets and outlets for the liquid or fluid to flow therethrough. The inlets and outlets of the cooling lines may be configured in any number of ways and are not meant to be limited.

Figures 8, 9, 10, 11:
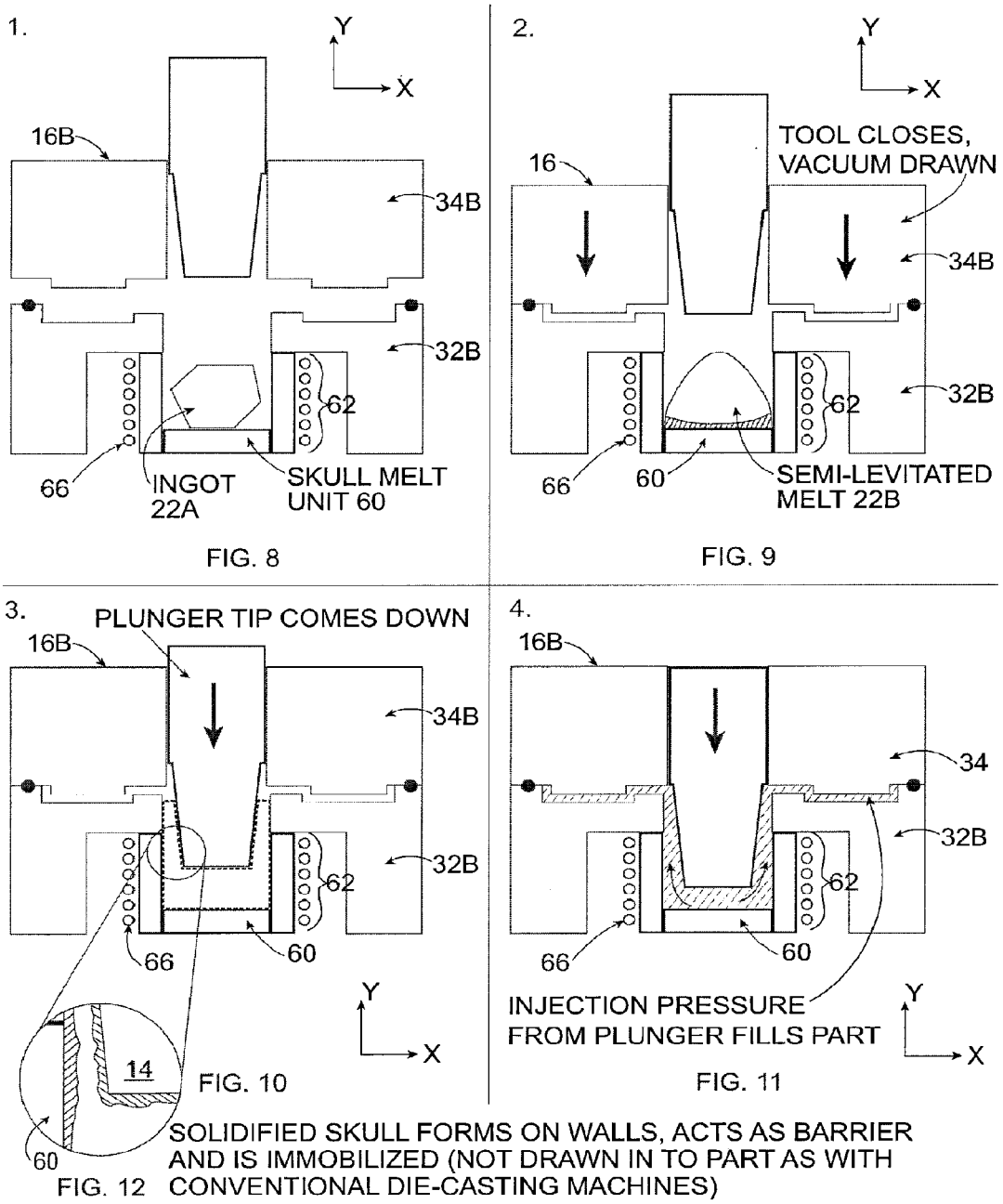
FIGS. 8-11 illustrate steps in a method of cold skull injection casting that can be implemented within a vertical system in accordance with an embodiment.

More specifically, FIG. 8 shows the machine when meltable material is received in the container 60, and ready for melting. The mold 16B is open. Once the first plate 32B and second plate 34B of the mold 16B are adjacent each other and the mold is closed (e.g., by moving second plate 34B towards first plate 32B), a vacuum is applied to the mold 16B and melt zone 62, as shown in FIG. 9. The material is melted within container 60 by induction source 66, creating a semi-levitated melt 22B. After the material is melted, the induction source 66 may or may not continue heating the material. The plunger 14B is moved in a vertical direction downward and into the container 60, contacting the melt 22B, as shown in FIG. 10. As shown in the detail of FIG. 12, at most, solidified skull material is formed on walls of the plunger 14 (e.g., its tip) and container 60. Such skull material acts as barrier and is immobilized on these walls, and thus is not drawn into the part (as may be with conventional die casting machines), because this machine is designed to use pressure to move molten material. More specifically, referring to FIG. 11, as the plunger 14B is moved further downward into container 60, it moves the molten material/melt 22B via pressure into the cavities of mold 16. That is, the molten material is moved in a direction that is opposite to a direction of movement of the plunger, i.e., upwardly into the mold. The molten material/melt moves around the plunger tip, as shown by the arrows and into the mold 16.

Accordingly, the described machine and method of FIGS. 8-12 provide a method of reducing the amount of prematurely frozen metal entering the mold and thus formed in a molded part. Any type of frozen or skull material is effectively immobilized on edges of the plunger and (cold) container walls, and does not move away from these surfaces during the process. The skull material can be removed after the molding process is finished, for example.

Accordingly, the herein disclosed embodiments illustrate an exemplary injection system aligned along a vertical axis with features designed to improve performance of such a machine. For example, some embodiments reduce cooling of molten material before it is molded, so that skull (or crystalline, or frozen, or solidified) material is not formed in the molten material before molding. By keeping any solidified portions of molten material away or out of the mold (so that they are not in the molded part) using one or more of the herein disclosed features (e.g., vertically positioned machine, decreasing the distance between heating and injection), a more homogeneous part is formed. With the herein described plunger configuration, the amount of vacuum lost from the mold and the amount of time for pressurizing the system under vacuum is reduced.

The disclosed system and described embodiments enables injection molding of objects to be performed at a faster volumetric flow rate than plastic injection molding techniques (but may be slower than conventional die cast machines). For example, the flow rate of casting using the herein described system(s) may be performed at approximately zero to 1,000 $cm^3$.

Although not described in great detail, the disclosed injection system may include additional parts including, but not limited to, one or more sensors, flow meters, etc. (e.g., to monitor temperature, cooling water flow, etc.), and/or one or more controllers. Also, seals can be provided with or adjacent any of number of the parts to assist during melting and formation of a part of the molten material when under vacuum pressure, by substantially limiting or eliminating substantial exposure or leakage of air. For example, the seals may be in the form of an O-ring. A seal is defined as a device that can be made of any material and that stops movement of material (such as air) between parts which it seals. The injection system may implement an automatic or semi-automatic process for inserting meltable material therein, applying a vacuum, heating, injecting, and molding the material to form a part.

The material to be molded (and/or melted) using any of the embodiments of the injection system as disclosed herein may include any number of materials and should not be limited. In one embodiment, the material to be molded using the disclosed injection molding system 10 is an amorphous alloy, which are metals that may behave like plastic, or alloys with liquid atomic structures, as previously described, for example.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. An injection molding system comprising:
- a mold defining a mold cavity;
- a melt zone connected to the mold cavity via a shot sleeve;
- a plunger configured to push a material from the melt zone into the mold cavity through the shot sleeve; and
- a sealing member surrounding a portion of the plunger and configured to:
  - remain at least partially out of contact with the shot sleeve when the plunger is moved in a first direction; and
  - contact the shot sleeve when the plunger is moved in a second direction opposite the first direction, thereby forming a seal between the melt zone and the mold cavity.

2. The system according to claim 1, further comprising a sealing sleeve at least partially surrounding a portion of the plunger and configured to compress the sealing member between a portion of the sealing sleeve and a portion of the plunger when the plunger is moved in the second direction, thereby forcing the sealing member into contact with the shot sleeve.

3. The system according to claim 2, wherein:
- the plunger comprises:
  - a plunger rod; and
  - a plunger tip at an end of the plunger rod and comprising a sealing surface facing away from the mold;
- the sealing sleeve surrounds at least a portion of the plunger rod; and
- the sealing member is disposed between an end of the sealing sleeve and the sealing surface.

4. The system according to claim 1, further comprising at least one mold seal positioned between a first plate of the mold and a second plate of the mold.

5. The system according to claim 1, further comprising a controller configured to cause the plunger to move in the second direction upon opening of the mold to eject a molded part from the mold cavity.

6. The system according to claim 1, wherein the sealing member is configured to maintain a vacuum in the melt zone when the sealing member is in contact with the shot sleeve.

7. The system according to claim 1, wherein the sealing member is an O-ring.

8. An injection molding system comprising:
- a melt zone;
- a mold defining a mold cavity;
- a shot sleeve connecting the melt zone to the mold cavity; and
- a plunger positioned at least partially in the shot sleeve and comprising:
  - a plunger rod; and
  - a flange extending radially from a surface of the plunger rod;
- a sleeve at least partially surrounding a portion of the plunger rod and having an end separated from the flange by a gap; and
- a seal surrounding the plunger rod and positioned in the gap; wherein
- the flange is movable relative to the sleeve to reduce a size of the gap, thereby compressing the seal to cause the seal to contact the shot sleeve;
- the seal is configured to remain at least partially out of contact with the shot sleeve when the seal is substantially uncompressed between the flange and the end of the sleeve; and
- when the seal is at least partially out of contact the shot sleeve, an environment of the melt zone and an environment of the mold cavity are connected.

9. The injection molding system of claim 8, wherein when the seal contacts the shot sleeve, the seal substantially isolates the environment of the melt zone from the environment of the mold cavity.

10. The injection molding system of claim 8, wherein when the seal is compressed between the flange and the end of the sleeve, the seal expands radially and contacts a surface of the melt zone.

11. The injection molding system of claim 8, wherein:

the plunger is configured to move in a first direction; and the sleeve is configured to move in a second direction opposite the first direction, thereby reducing the size of the gap.

12. The injection molding system of claim 8, wherein:

the plunger and the sleeve are configured to move in a first direction to eject material from the melt zone into the mold cavity;

the plunger is configured to move in a second direction opposite the first direction after ejecting the material from the melt zone into the mold cavity; and the sleeve is configured to remain substantially stationary while the plunger is moved in the second direction after the material is ejected, thereby reducing the size of the gap.

13. A method, comprising:

pushing, with a plunger, a molten material through a shot sleeve and into a mold cavity of a mold connected to the shot sleeve;

cooling the molten material to form a part;

moving the plunger relative to a sleeve at least partially surrounding the plunger to compress a sealing member in a gap between an end of the sleeve and a surface of the plunger, thereby forcing the sealing member against a wall of the shot sleeve;

while the sealing member is forced against the wall of the shot sleeve, opening the mold; and ejecting the part; wherein at least part of the sealing member does not contact the wall of the shot sleeve during at least part of the operation of pushing the molten material through the shot sleeve and into the cavity.

14. The method of claim 13, wherein the operation of moving the plunger relative to the sleeve comprises moving the plunger while the sleeve remains substantially stationary.

15. The method of claim 13, wherein the operation of moving the plunger relative to the sleeve comprises moving the plunger and the sleeve in opposite directions.

16. The method of claim 13, wherein:

the method further comprises, prior to pushing the molten material through the shot sleeve and into the mold cavity:

applying a vacuum to a melt zone and the mold cavity; and melting a material in the melt zone, thereby forming the molten material; and the sealing member substantially maintains the vacuum in the melt zone while the mold is open.

17. The method of claim 16, wherein the mold cavity is substantially at atmospheric pressure when the mold is open.

* * * * *